US010410496B1

(12) United States Patent
Child et al.

(10) Patent No.: US 10,410,496 B1
(45) Date of Patent: Sep. 10, 2019

(54) OCCUPANCY-TARGETED BABY MONITORING

(71) Applicant: Vivint, Inc., Provo, UT (US)

(72) Inventors: Michael D. Child, Lehi, UT (US); Michelle Zundel, Draper, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/852,138

(22) Filed: Dec. 22, 2017

Related U.S. Application Data

(63) Continuation of application No. 15/000,839, filed on Jan. 19, 2016, now Pat. No. 9,858,789.

(51) Int. Cl.
*G08B 21/02* (2006.01)

(52) U.S. Cl.
CPC ..... *G08B 21/0211* (2013.01); *G08B 21/0208* (2013.01)

(58) Field of Classification Search
CPC ..... G08B 21/0211; G08B 21/0208
USPC ..... 340/573.1
See application file for complete search history.

(56) References Cited

U.S. PATENT DOCUMENTS 6,968,294 B2 11/2005 Gutta et al.
2011/0313259 A1* 12/2011 Hatakeyama ..... A61B 5/18 600/300
2014/0142729 A1 5/2014 Lobb et al.
2015/0070190 A1* 3/2015 Wai Fong ..... G01J 1/4204 340/870.3
2015/0097663 A1 4/2015 Sloo et al.
2016/0035205 A1* 2/2016 Messenger ..... A61B 5/746 340/539.15
2016/0293026 A1 10/2016 Pradeep et al.
2017/0180947 A1* 6/2017 Shafi ..... H04W 4/04

FOREIGN PATENT DOCUMENTS

EP 0113533 B1 2/1989

OTHER PUBLICATIONS

SmartHome Management System Brochure, EyStar, 2005.

* cited by examiner

*Primary Examiner* — Dhaval V Patel
(74) *Attorney, Agent, or Firm* — Holland & Hart, LLP

(57) ABSTRACT

The present disclosure is directed to systems and methods for security and/or automation systems. The methods may include detecting an event in a home associated with a first occupant of the home, and identifying a presence of a second occupant in the home. In any embodiment, the second occupant may be different from the first occupant. The method may further include providing an alert to the second occupant of the home based at least in part on the detected event and the identifying.

20 Claims, 8 Drawing Sheets

OCCUPANCY-TARGETED BABY MONITORING

CROSS-REFERENCE TO RELATED APPLICATIONS

The present application is a continuation of U.S. patent application Ser. No. 15/000,839, filed Jan. 19, 2016, titled "OCCUPANCY-TARGETED BABY MONITORING," and assigned to the assignee hereof, the disclosure of which is expressly incorporated herein in its entirety by this reference.

BACKGROUND

The present disclosure, for example, relates to security and/or automation systems, and more particularly to providing occupancy-targeted baby monitoring within a structure.

Security and automation systems are widely deployed to provide various types of communication and functional features such as monitoring, communication, notification, and/or others. These systems may be capable of supporting communication with a user through a communication connection or a system management action.

When a parent wishes to monitor his baby from another room, the parent may position one monitoring unit in the baby's room, and may carry the other monitoring unit as he moves throughout his home. When the baby cries, the parent may hear the crying, and may tend to his baby. Current systems may be limiting, however, because they may require the parent's constant proximity to a monitoring unit and may include only limited battery life. Additionally, existing baby monitoring systems may include only one monitoring unit with limited capabilities, such that more than one parent may not be able to separately monitor the baby or another occupant or may be limited in how to attend to a person. Thus, there is a need in the art for more adaptive means for monitoring to overcome these and other problems.

SUMMARY

The present disclosure provides systems and methods for adaptive baby monitoring, utilizing components of a home automation system. For example, the present invention provides a method for security and/or automation systems, which may include detecting an event in a home associated with a first occupant of the home. The method may further include identifying a presence of a second occupant in the home, the second occupant different from the first occupant. The method may further include providing an alert to the second occupant of the home based at least in part on the detected event and the identifying. In this way, a parent may be notified that his baby is crying, regardless of where the parent is located inside or outside the home, by using components of the home automation system. For example, one or more audio and/or video monitors may be located in the baby's room. Additional monitors and/or sensors may be located throughout the home, configured to detect occupancy, identify particular occupants, detect sound or movement, or broadcast audio, visual, textual, or haptic messages or alerts, or a combination thereof. The one or more audio or video monitors in the baby's room may detect that the baby is crying, grunting, speaking, and/or moving, among other things.

In some examples, the mere detection of sound from the baby's room may trigger an event, which may be a baby crying event. In other examples, a parent may input a predetermined baby crying event threshold preference, for example requiring that the baby cry for a particular period of time, or at a particular decibel level, or a combination thereof, before the sound is identified as a crying event. Upon detection of the baby crying event, the home automation system may "look for" the parent inside the home, using one or more sensors and/or components positioned throughout the home. For example, an occupancy detection sensor positioned in the family room may identify movement and deduce that the parent is in the living room. Accordingly, an alert may be communicated to the parent in the living room, notifying him that his baby is crying. The alert may take the form of an auditory or visual alert or message, or may include a haptic alert, such as a vibration, or any combination thereof. Because the alert has been directed to a room in which the parent is known to be currently located, the parent may be quickly and effectively notified that his baby is crying, and he may tend to his child.

In another example, an alert may be provided to an individual household member with more particularity. For example, where the home is occupied by multiple family occupants, friends, neighbors, or guests, it may be desirable to notify only one or more parents that the baby is crying, without disturbing the home's other occupants. This may be achieved by utilizing one or more sensors and/or other components positioned throughout the home to detect general occupancy and the identity of each occupant, among other things. For example, the home automation system may compare heart rate, respiration rate, weight, height, facial recognition data, other physiological data, the location of a device associated with a certain person, and/or other information detected by the one or more sensors and/or components with previously-inputted family member profiles in order to identify occupants in the home and determine their absolute and/or relative locations. In other examples, the home automation system may distinguish between occupants who are engaged in certain first activities (e.g., sleeping) and those engaged in other second activities (e.g., those who are awake), and may notify only those occupants who are in certain first activities, such as being awake, that an event has occurred (e.g., a baby is crying). In still other examples, alerts may be provided based on a combination of occupant identity and sleep status data, among other things.

In some examples, the form of the provided alert may be modified based on detected home and/or occupant parameters, among other things. For example, where the one or more sensors detect high ambient noise levels in a particular room in the home, for example because of a party or television show, the alert may be provided at a higher volume, or an alert may be provided as a different type or different types of alerts (e.g., a visual alert), such as a flashing light or message displayed on a control panel or personal computing device, in order to ensure effective notification that the baby is crying. Conversely, where the one or more sensors detect low ambient noise level(s) in the home, the audio alert may be provided at a lower volume, or an alert may be provided as a haptic alert, such as a vibration, so as to avoid disturbing guests or others in the home.

In this way, the occupancy-targeted baby monitoring system and methods may "follow" the parent throughout the home and may modify the form of the alert provided to most effectively notify the parent of the baby crying event. In some examples, the one or more audio and/or video monitors monitoring the child and initiating and/or delivering the alert, and/or transmitting the live audio and/or video feed of the baby crying, may be operable for two-way communication, such that the parent may soothe her child from her current location in the home. In some examples, the one or more sensors may detect both the location of the parent in the home, and the location of the parent's smartphone or other computing device with respect to the parent. In some examples, this determination and/or other steps may be based at least in part on detecting wireless signals emitted by the device. Based on this location detection, the home automation system may determine whether to provide the alert at a control panel and/or other component of the home automation system, and/or at the parent's smartphone and/or personal computing device, depending upon which notification means and location is more and/or most likely to effectively notify the parent. This determination of the most efficacious notification means may be based on distance from the parent to a device, the location of other occupants in the home, detected sounds and/or activities in the home, user preferences (e.g., a preference to receive such alerts on a wearable device), a selected and/or a default device, an order of devices (e.g., first sending an alert to a wearable device, then a smartphone, then an indoor camera, then a panel), some other combination, and/or other things.

Although described above with respect to baby monitoring and baby crying events, the present disclosure may be applicable to any user monitoring, for example monitoring an ill or elderly household member, and may be applicable to detect any number of alert conditions beyond crying, such as heart rate events, movement events, respiratory events, acceleration or posture events, some combination thereof, and/or the like.

In some embodiments, detecting the event may include receiving an event threshold, detecting audio data, and/or comparing the detected audio data with the event threshold. In some embodiments, the event threshold may include an occupant-inputted event threshold. In some embodiments, the event may include a baby crying event. In some embodiments, the event may include a baby movement event.

In some embodiments, the method may include receiving an alert preference, detecting the event in the home, and/or providing the alert to the second occupant based at least in part on the alert preference. In some embodiments, the alert preference may include an occupant-inputted alert preference. In some embodiments, the alert preference may include at least one of an individual occupant to alert, or a location at which to provide the alert, or a form in which to provide the alert, or a combination thereof.

In some embodiments, the alert is provided to the second occupant based on a relative location of the second occupant in the home. In some embodiments, the method may include comparing a location of the second occupant with a location of at least one of a camera, or a speaker, or a control panel, or a personal computing device, and providing the alert based at least in part on the comparing.

In some embodiments, the method may include comparing a location of the second occupant with a location of at least two of a camera, or a speaker, or a control panel, or a personal computing device, providing the alert based at least in part on the comparing. In some embodiments, the provided alert may include at least one of an auditory alert, or a visual alert, or a haptic alert, or an audio stream, or a video stream, or a combination thereof.

In some embodiments, the provided alert may be communicated to the second occupant by at least one of a camera, or a speaker, or a control panel, or a personal computing device, or a combination thereof. In some embodiments, the method may include detecting physiological data associated with the second occupant in the home, and providing a modified alert based at least in part on the detected physiological data.

In some embodiments, providing the modified alert may include at least one of modifying a location of the alert, or a volume of the alert, or a format of the alert, or a recipient of the alert, or a combination thereof. In some embodiments, the detected physiological data may include at least one of a heart rate, or a respiration rate, or a body temperature, or facial recognition data, or movement data, or a height, or a weight, or a combination thereof.

In some embodiments, the present disclosure may relate to an apparatus for security and/or automation systems, which may include a processor, a memory in electronic communication with the processor, and instructions stored in the memory. In any embodiment, the instructions stored in the memory may be executable by the processor to detect an event in a home associated with a first occupant of the home, identify a presence of a second occupant in the home, the second occupant different from the first occupant; and provide an alert to the second occupant of the home based at least in part on the detected event and the identifying.

In other embodiments, the present disclosure may relate to a non-transitory computer-readable medium storing computer-executable code, the code executable by a processor to detect an event in a home associated with a first occupant of the home; identifying a presence of a second occupant in the home, the second occupant different from the first occupant; and provide an alert to the second occupant of the home based at least in part on the detected event and the identifying.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

The present disclosure describes systems and methods for occupancy-targeted baby monitoring, such that a parent may stay apprised of his baby's status, regardless of his own location within the home. Certain baby monitoring systems may limit parents to remaining in a room with a stationary baby monitoring device, or to carrying a mobile monitoring device as they move throughout the home. These systems may be limiting and inconvenient, and may be unreliable in that monitoring systems may run out of batteries without the parents' knowledge. There is a need for an adaptive system that, based on occupancy and location, follows the monitoring user throughout the home, and tailors baby-related alerts to the monitoring user's location and alert preferences; the present disclosure describes systems and methods for such adaptive baby monitoring.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
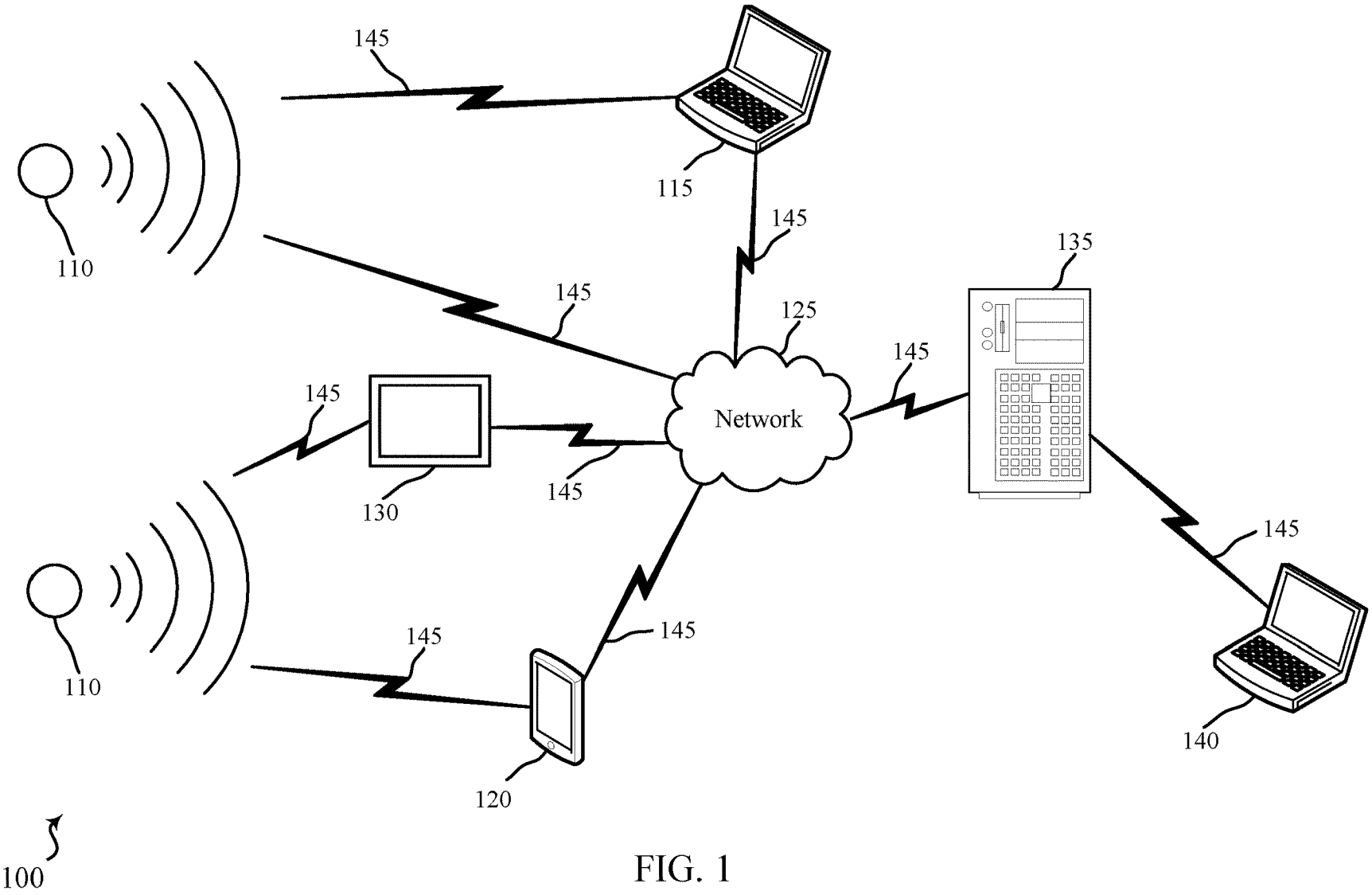
FIG. 1 is a block diagram of an example of a security and/or automation system in accordance with various aspects of this disclosure.

FIG. 1 is an example of a security and/or automation system 100 in accordance with various aspects of this disclosure. In some embodiments, the security and/or automation system 100 may include one or more sensor units 110, local computing device 115, 120, network 125, server 135, control panel 130, and remote computing device 140. One or more sensor units 110 may communicate via wired or wireless communication links 145 with one or more of the local computing device 115, 120 or network 125. The network 125 may communicate via wired or wireless communication links 145 with the control panel 130 and the remote computing device 140 via server 135. In alternate embodiments, the network 125 may be integrated with any one of the local computing device 115, 120, server 135, or remote computing device 140, such that separate components are not required.

Local computing device 115, 120 and remote computing device 140 may be custom computing entities configured to interact with one or more sensor units 110 via network 125, and in some embodiments, via server 135. In other embodiments, local computing device 115, 120 and remote computing device 140 may be general purpose computing entities such as a personal computing device, for example, a desktop computer, a laptop computer, a netbook, a tablet personal computer (PC), a control panel, an indicator panel, a multi-site dashboard, an iPod®, an iPad®, a smartphone, a mobile phone, a personal digital assistant (PDA) a smartwatch, a wearable electronic device, and/or any other suitable device operable to send and receive signals, store and retrieve data, and/or execute modules.

Control panel 130 may be a smart home system panel, for example, an interactive panel mounted on a wall in a user's home. Control panel 130 may be in direct communication via wired or wireless communication links 145 with the one or more sensor units 110, or may receive sensor data from the one or more sensor units 110 via local computing devices 115, 120 and network 125, or may receive data via remote computing device 140, server 135, and network 125.

The local computing devices 115, 120 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing devices 115, 120 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from one or more sensor units 110.

The processor of the local computing devices 115, 120 may be operable to control operation of the output of the local computing devices 115, 120. The output may be a television, a liquid crystal display (LCD) monitor, a cathode ray tube (CRT) monitor, speaker, tactile output device, and/or the like. In some embodiments, the output may be an integral component of the local computing devices 115, 120. Similarly stated, the output may be directly coupled to the processor. For example, the output may be the integral display of a tablet and/or smartphone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing devices 115, 120 to the output.

The remote computing device 140 may be a computing entity operable to enable a remote user to monitor the output of the sensor units 110. The remote computing device 140 may be functionally and/or structurally similar to the local computing devices 115, 120 and may be operable to receive data streams from and/or send signals to at least one of the one or more sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via wireless communication links 145 and server 135.

In some embodiments, the one or more sensor units 110 may be sensors configured to conduct periodic or ongoing automatic functions (e.g., identifications, determinations, measurements, etc.) associated with a baby. Each sensor unit 110 may be capable of sensing one or more physiological, audio, video, environmental, and/or motion parameters associated with the baby, or alternatively, separate sensor units 110 may monitor separate parameters associated with the baby. For example, one sensor unit 110 may measure audio, for example by detecting the sound of the baby crying, coughing, cooing, or the like, while another sensor unit 110 (or, in some embodiments, a different element of the same sensor unit 110) may detect the baby's heart rate and/or respiratory rate, for example by monitoring chest expansions and contractions, among other things. In some embodiments, one or more sensor units 110 may additionally monitor alternative parameters associated with the baby or the baby's environment, such as room temperature, ambient light levels, and the like. Sensor units 110 may also monitor movement or posture data associated with the baby, for example to determine if the baby is sleeping restlessly (based, for example, upon a detected increase in movement such as moving his arms or legs), and/or has stood up in his crib. Although described with respect to baby monitoring, these periodic or ongoing automatic measurements could also be performed on an ill or elderly family member, or any other occupant in need of monitoring.

Data gathered by the one or more sensor units 110 may be communicated to local computing device 115, 120, which may be, in some embodiments, a thermostat or other wall-mounted input/output smart home display. In other embodiments, local computing device 115, 120 may be a personal computer or a smartphone, among other things. Where local computing device 115, 120 is a smartphone, the smartphone may have a dedicated application directed to receiving and displaying or broadcasting alerts associated with the monitored baby. The local computing device 115, 120 may process the data received from the one or more sensor units 110 to derive an event condition and/or an alert condition. In some embodiments, remote computing device 140 may process the data received from the one or more sensor units 110, via network 125 and server 135, to derive an event condition and/or an alert condition. In some embodiments, live video and/or audio data streams may be communicated from the one or more sensor units 110 to local computing device 115, 120, such that a user may monitor the baby's real-time status without the need for a derived alarm condition. Data transmission may occur via, for example, frequencies appropriate for a personal area network (such as BLUETOOTH® or IR communications) or local or wide area network frequencies such as radio frequencies specified by the IEEE 802.15.4 standard, among others.

In some embodiments, local computing device 115, 120 may communicate with remote computing device 140 or control panel 130 via network 125 and server 135. Examples of networks 125 include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 115, 120 from remote computing device 140. For example, in some embodiments, remote computing device 140 may include a mobile application that interfaces with one or more functions of local computing device 115, 120.

The server 135 may be configured to communicate with the one or more sensor units 110, the local computing devices 115, 120, the remote computing device 140, and control panel 130. The server 135 may perform additional processing on signals received from the one or more sensor units 110 or local computing devices 115, 120, or may simply forward the received information to the remote computing device 140 and control panel 130.

Server 135 may be a computing device operable to receive data streams (e.g., from one or more sensor units 110 and/or local computing device 115, 120 or remote computing device 140), store and/or process data, and/or transmit data and/or data summaries (e.g., to remote computing device 140). For example, server 135 may receive a stream of audio data from a sensor unit 110, a stream of physiological data from the same or a different sensor unit 110, and a stream of video data from either the same or yet another sensor unit 110. In some embodiments, server 135 may "pull" the data streams, e.g., by querying the sensor units 110, the local computing devices 115, 120, and/or the control panel 130. In some embodiments, the data streams may be "pushed" from the sensor units 110 and/or the local computing devices 115, 120 to the server 135. For example, the sensor units 110 and/or the local computing device 115, 120 may be configured to transmit data as it is generated by or entered into that device. In some instances, the sensor units 110 and/or the local computing devices 115, 120 may periodically transmit data (e.g., as a block of data or as one or more data points).

The server 135 may include a database (e.g., in memory) containing audio, video, physiological, occupancy, past monitoring action(s), and/or other data received from the sensor units 110 and/or the local computing devices 115, 120, among other components. Additionally, as described in further detail herein, software (e.g., stored in memory) may be executed on a processor of the server 135. Such software (executed on the processor) may be operable to cause the server 135 to monitor, process, summarize, present, and/or send a signal associated with the monitored baby data.

Figure 2:
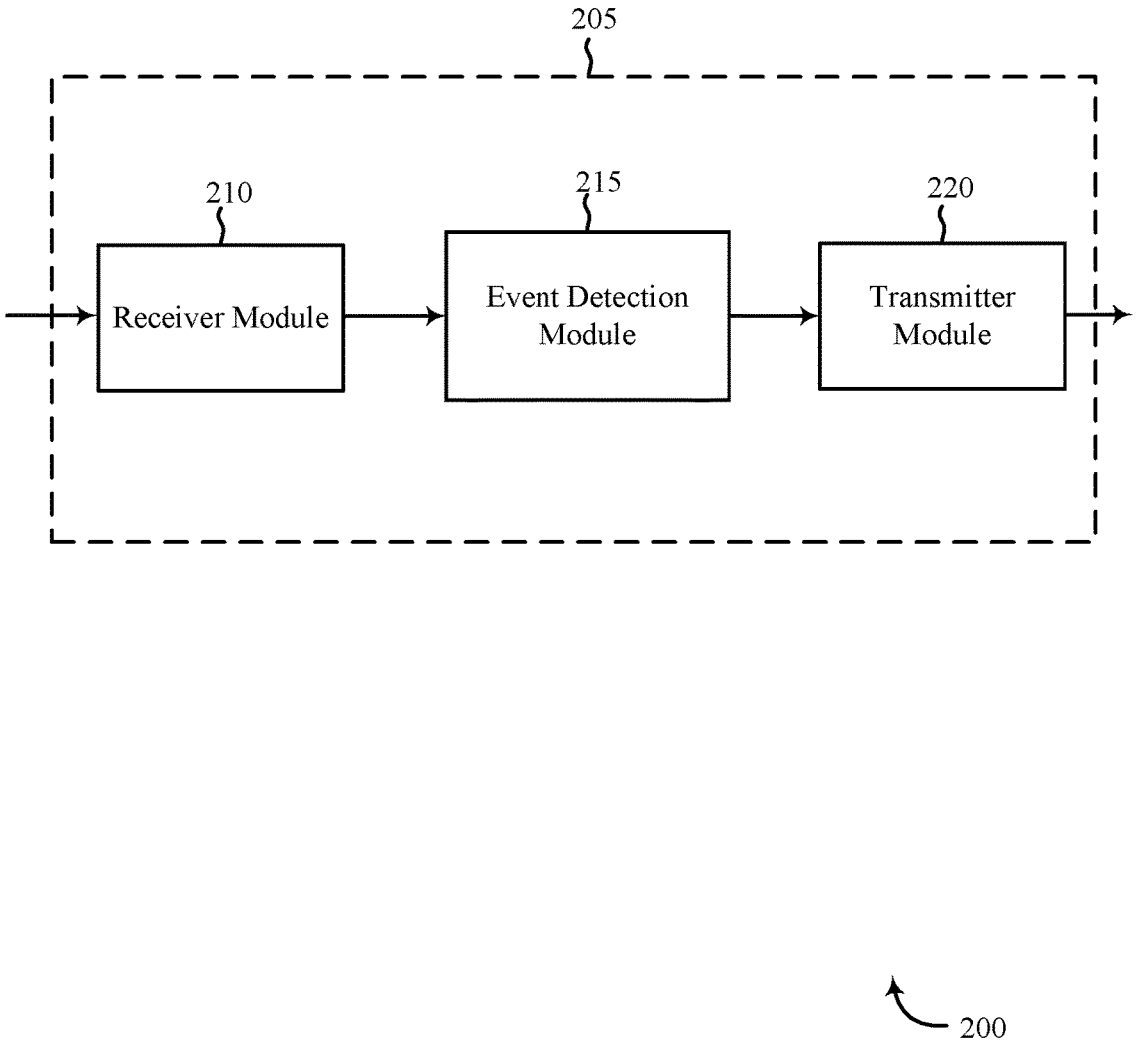
FIG. 2 shows a block diagram of a device relating to a security and/or an automation system, in accordance with various aspects of this disclosure.

FIG. 2 shows a block diagram 200 of an apparatus 205 for use in security and/or automation systems, in accordance with various aspects of this disclosure. The apparatus 205 may be an example of one or more aspects of any of a control panel 130, one or more sensor units 110, local computing device 115, 120, and/or remote computing device 140 described with reference to FIG. 1. The apparatus 205 may include a receiver module 210, an event detection module 215, and/or a transmitter module 220. The apparatus 205 may also be or include a processor. Each of these modules may be in communication with each other, directly and/or indirectly.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). In some embodiments, where the receiver module 210 is an example of one or more aspects of the one or more sensor units 110 of FIG. 1, the receiver module 210 may be configured to detect any of audio, video, physiological (including posture, sleep status, identity, etc.), and/or movement (including occupancy and location) data associated with the baby or other monitored user. In other embodiments, where the receiver module 210 is an example of one or more aspects of the local computing device 115, 120, control panel 130, or remote computing device 140, the receiver module 210 may be configured to receive any of audio, video, physiological (including posture, sleep status, identity, etc.), and/or movement (including occupancy and location) data associated with the monitored baby or other user, where such data is detected by one or more sensor units positioned near the baby. In any embodiment, data associated with the monitored baby or user may be passed on to the event detection module 215, and to other components of the apparatus 205.

In some embodiments, event detection module 215 may pass the data associated with the monitored baby received from receiver module 210 directly to transmitter module 220, without processing, for communication to the parent or other monitoring user. For example, where receiver module 210 transmits live audio data to event detection module 215, such live audio data may be communicated directly to the parent via transmitter module 220, for example at the parent's smartphone or at a control panel located near the parent. In this way, the parent may monitor the baby's status in real-time.

In other embodiments, event detection module 215 may receive data associated with the monitored baby from receiver module 210, and may process that data to detect an event. For example, where receiver module 210 transmits physiological data, such as the baby's heart rate, to event detection module 215, event detection module 215 may compare the received heart rate data with a heart rate threshold to determine whether the baby is experiencing a heart rate event. This heart rate threshold may be based upon heart rate parameters inputted by system users, for example at a control panel or other component of the automation system, or may be based upon an accepted threshold, for example programmed into the automation system based on the size, age, and/or weight of the baby (among other factors) and standard heart rates and/or heart rate patterns for comparable babies and/or other people. Thus, where receiver module 210 communicates a detected heart rate below or above the heart rate threshold, event detection module 215 may determine that the baby is experiencing a heart rate event, and may initiate and/or derive an alert accordingly. This alert may be communicated to transmitter module 220 for transmission to the parent, another monitoring user, and/or a device.

The transmitter module 220 may transmit the one or more signals received from other components of the apparatus 205. As described above, the transmitter module 220 may transmit data received from receiver module 210 directly to the monitoring user without further processing by event detection module 215 in some examples, or in other examples may transmit an alert derived by event detection module 215 as a result of event detection module 215 processing the data received from receiver module 210. In some examples, the transmitter module 220 may be collocated with the receiver module 210 in a transceiver module. Data or signals transmitted from transmitter module 220 may be received by a parent or other monitoring user at one or more components of the automation system, such as a control panel or a speaker unit, or may be received at a smartphone or a personal computing device associated with one or more home occupants and/or another monitoring user.

Figure 3:
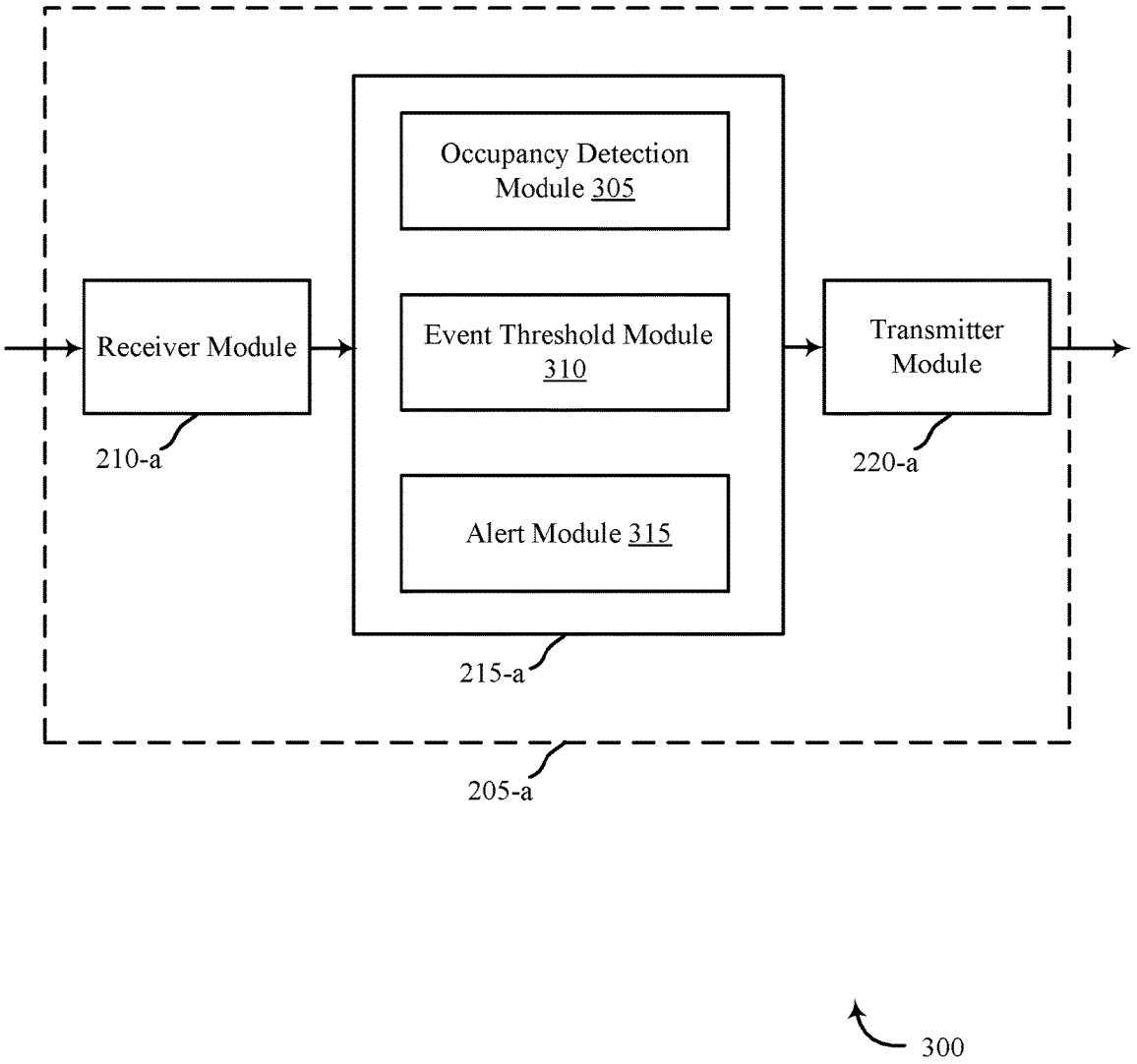
FIG. 3 shows a block diagram of a device relating to a security and/or an automation system, in accordance with various aspects of this disclosure.

FIG. 3 shows a block diagram 300 of an apparatus 205-*a* for use in automation and/or security systems, in accordance with various examples. The apparatus 205-*a* may be an example of one or more aspects of any of a control panel 130, one or more sensor units 110, local computing device 115, 120, and/or remote computing device 140 described with reference to FIG. 1, among others. It may also be an example of an apparatus 205 described with reference to FIG. 2. The apparatus 205-*a* may include a receiver module 210-*a*, an event detection module 215-*a*, and/or a transmitter module 220-*a*, which may be examples of the corresponding modules of apparatus 205. The apparatus 205-*a* may also include a processor. Each of these components may be in communication with each other. The event detection module 215-*a* may include one or more of an occupancy detection module 305, an event threshold module 310, and/or an alert module 315. The receiver module 210-*a* and the transmitter module 220-*a* may perform the functions of the receiver module 210 and the transmitter module 220 of FIG. 2, respectively.

The components of the apparatus 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Upon receiving data associated with the monitored baby or other user from receiver module 210-*a*, occupancy detection module 305 may identify occupancy data associated with the monitored home in order to determine a location, which may influence and/or direct communicating data to one or more users and/or devices. Occupancy may be detected using any means, such as by utilizing one or more sensors to detect movement, vibration, temperature, wireless signal, audio, and/or visual data. For example, occupancy detection module 305 may detect, using one or more sensor units configured to detect vibration, that the living room is occupied based at least in part on detected vibration data in the living room. In some examples, occupancy detection module 305 may detect mere occupancy, without further identifying the particular occupant. In other examples, as discussed in more detail below with respect to FIG. 4, the particular identity of one or more occupants may be detected. Based upon the detected occupancy data, transmitter module 220-*a* may then communicate the received data associated with the monitored baby, or the derived alert, to the appropriate one or more locations in the home. For example, transmitter module 220-*a* may communicate a live audio stream to one or more speakers positioned in the living room in which occupancy was detected by occupancy detection module 305. In some examples, transmitter module 220-*a* may communicate the data or an alert associated with the monitored person to a single location in the home based at least in part based at least in part on detected occupancy data, while in other examples, transmitter module 220-*a* may communicate the data or one or more alerts to a plurality of rooms or locations in the home based on detected occupancy data.

Event threshold module 310 may be configured to filter data associated with the monitored baby and received from receiver module 210-*a* in order to convey to the parent or other monitoring user only that data which satisfies one or more event thresholds. For example, where receiver module 210-*a* receives audio data associated with the monitored baby, event threshold module 310 may compare the audio data with a decibel threshold and/or a duration threshold in order to determine whether the audio data constitutes an event worth conveying to the parent. In this way, a parent may not be notified each time his baby sneezes or whimpers, but may be notified when the baby begins crying loudly or coughs for an extended period of time. In some embodiments, the event threshold may be determined based on inputted user preferences, for example at a control panel and/or a smartphone device, while in other examples, the event threshold may be determined based on commonly used standards for baby monitoring (e.g., from a database, from an Internet source, etc.) and/or from system-learned past monitoring preferences and/or settings. In some examples, where event threshold module 310 determines that the data associated with the monitored baby, such as audio or physiological data, constitutes an event, this event determination may be communicated to alert module 315 to derive an alert. In other examples, data associated with the monitored baby that is determined to constitute an event may be communicated directly to the monitoring parent via transmitter module 220-*a*, for example as a live video stream.

Alert module 315 may be configured to receive data from event threshold module 310 indicating that an event has occurred and/or is occurring, and may derive an alert accordingly. The alert may take the form of an audio alert, such as a siren or prerecorded audio message, among others; a visual alert, such as a flashing light or message displayed on a control panel or personal computing device, among others; and/or a haptic alert, such as a vibration at the monitoring parent's smartphone, among others. The alert derived at alert module 315, in any form, may be communicated to the monitoring users, where the monitoring users may be one or more parents, via transmitter module 220-*a*. In some examples, as discussed above, depending upon the occupancy data detected by occupancy detection module 305, the derived alert may be communicated only to occupied locations in the home. In other examples, the alert may be communicated throughout the home, regardless of occupancy.

Figure 4:
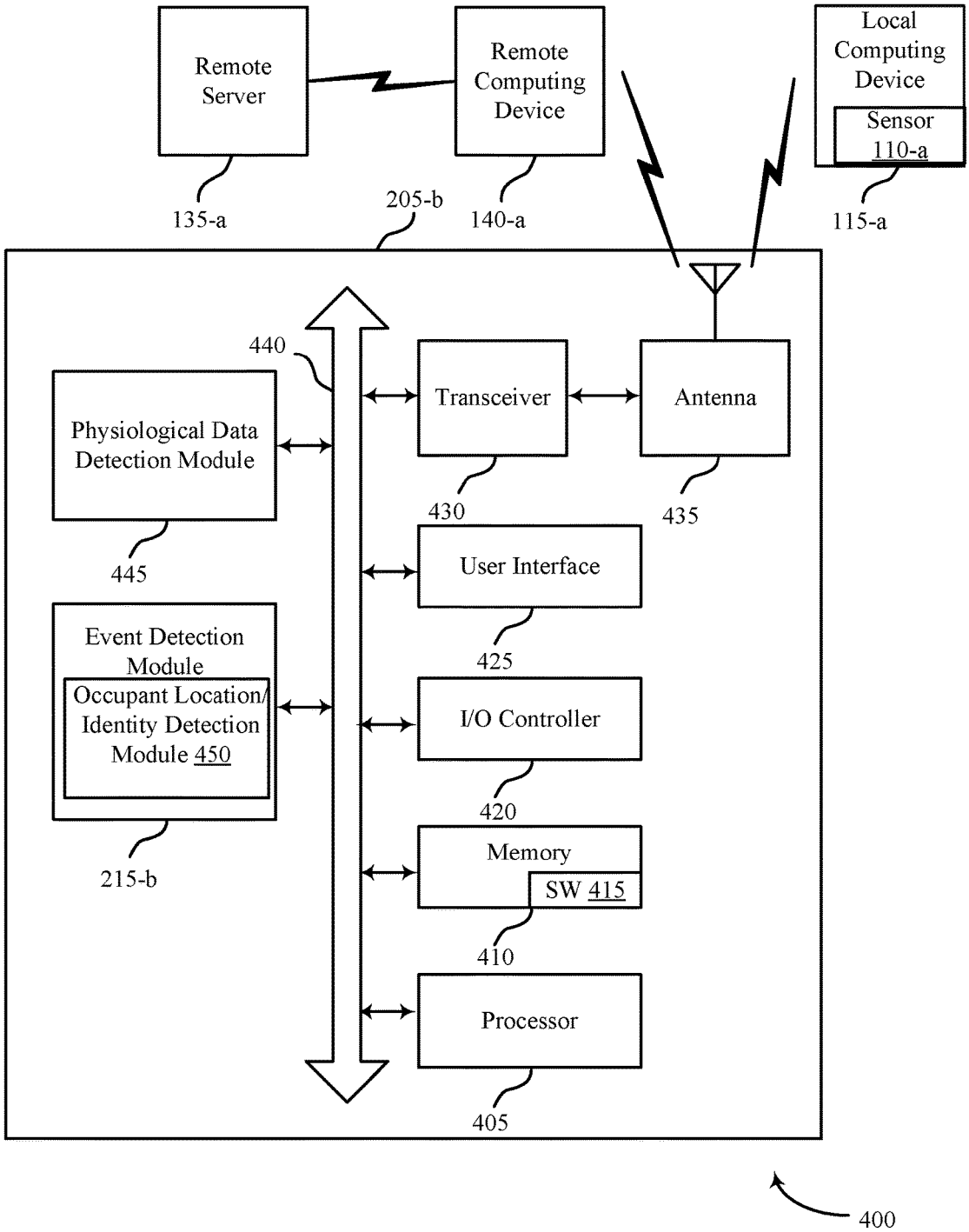
FIG. 4 shows a block diagram relating to a security and/or an automation system, in accordance with various aspects of this disclosure.

FIG. 4 shows a system 400 for use in security and/or automation systems, in accordance with various examples. System 400 may include an apparatus 205-*b*, which may be an example of one or more aspects of any of a control panel 130, one or more sensor units 110, local computing device 115, 120, and/or remote computing device 140 described with reference to FIG. 1, among others. Apparatus 205-*b* may also be an example of one or more aspects of apparatus 205 and/or 205-*a* of FIGS. 2 and 3.

Apparatus 205-*b* may include physiological data detection module 445. Physiological data detection module 445 may be configured to detect physiological data associated, not with the monitored baby, but with the other occupants of the home. This physiological data of the other home occupants may be utilized to determine whether and how to communicate data and/or alerts associated with the monitored baby. Physiological data may be detected directly by physiological data detection module 445, for example where apparatus 205-*b* is an example of a sensor unit, and/or physiological data may be received by physiological data detection module 445 from a separate one or more sensor unit, for example where apparatus 205-*b* is a control panel or local computing device. For example, where physiological data detection module 445 detects that a home occupant is sleeping, for example by detecting heart rate, respiration rate, movement, and/or the like, and that the occupant is a young child, for example by detecting weight or size of the occupant, the system may avoid broadcasting alerts or other data signals associated with the monitored baby to the room in which the child is sleeping, in order to avoid awakening her.

In other examples, where physiological data detection module detects and/or identifies that an adult occupant is sleeping, the system may amplify the volume, light, or haptic intensity at which the alert or other data associated with the monitored baby is communicated to the sleeping adult, in order to ensure that he or she awakens and receives the alert or data. Physiological data detection module 445 may also or alternatively detect data associated with the environment surrounding the other occupants in the home, for example ambient noise levels, in order to determine whether a louder or a softer audio alert is needed to alert the occupants.

Apparatus 205-*b* may also include occupant location/identity detection module 450, configured to identify particular occupants within the home, in order to appropriately direct alerts or other data associated with the monitored baby. Occupant identity detection module 450 may identify occupants by detecting or receiving data associated with facial recognition data, and may derive an identity of the occupant using one or more identification techniques. In other examples, occupant identity detection module 450 may detect the identity of an occupant using voice recognition, identification of a wireless signal emitted by a device associated with the occupant, physiological data such as height or weight, or the like. The identity of the detected occupant may then be compared with inputted preferences, settings, functions, operations, urgency of an alert, physiological data, or other data, or some combination thereof, and/or other information regarding alerts associated with the monitored occupant(s). For example, a user may input a preference at the control panel that the baby's parents should be notified of any alert conditions associated with the baby, or should receive data associated with the baby, while the baby's siblings should not. Thus, where occupant identity detection module 450 identifies that the baby's mother is in the living room, while the baby's brother is in the kitchen, any data or alerts associated with the baby may be communicated only to the mother in the living room and/or to the mother as she moves from the living room to one or more different rooms, and may not be communicated to the brother in the kitchen.

Apparatus 205-*b* may also include components for bidirectional data communications including components for transmitting communications and components for receiving communications. For example, apparatus 205-*b* may communicate bi-directionally with one or more of local computing device 115-*a*, one or more sensor units 110-*a*, remote computing device 140-*a*, and/or remote server 135-*a*, which may be examples of the local computing device 115, one or more sensor units 110, and server 135 of FIG. 1, among others. This bi-directional communication may be direct (e.g., apparatus 205-*b* communicating directly with remote computing device 140-*a*) and/or indirect (e.g., apparatus 205-*b* communicating indirectly with remote server 135-*a* through remote computing device 140-*a*).

Apparatus 205-*b* may also include a processor module 405, and memory 410 (including software/firmware code (SW) 415), an input/output controller module 420, a user interface module 425, a transceiver module 430, and one or more antennas 435, each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of local computing device 115-*a*, remote computing device 140-*a*, and/or remote server 135-*a*. The transceiver module 430 may include a modem to modulate the packets and provide the modulated packets to the one or more antennas 435 for transmission, and to demodulate packets received from the one or more antenna 435. While a an apparatus (e.g., 205-*b*) may include a single antenna 435, the apparatus may also have multiple antennas 435 capable of concurrently transmitting or receiving multiple wired and/or wireless transmissions. In some embodiments, one element of apparatus 205-*b* (e.g., one or more antennas 435, transceiver module 430, etc.) may provide a direct connection to a remote server 135-*a* via a direct network link to the Internet via a POP (point of presence). In some embodiments, one element of apparatus 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more sensor units 110-*a* (e.g., motion, audio, video, physiological, and/or one or more other sensors) may connect to some element of system 400 via a network using one or more wired and/or wireless connections.

In some embodiments, the user interface module 425 may include an audio device, such as an external speaker system, an external display device such as a display screen, and/or an input device (e.g., remote control device interfaced with the user interface module 425 directly and/or through input/output controller module 420).

One or more buses 440 may allow data communication between one or more elements of apparatus 205-*b* (e.g., processor module 405, memory 410, input/output controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., detect data, such as audio or video, associated with the monitored baby, compare the detected data with predetermined event thresholds to determine whether the data constitutes an event, derive an alert based on the event, etc.). Alternatively, the computer-executable software/firmware code 415 may not be directly executable by the processor module 405 but may cause a computer (e.g., when compiled and executed) to perform functions described herein. Alternatively, the computer-readable, computer-executable software/firmware code 415 may not be directly executable by the processor module 405 but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 may contain, among other things, the Basic Input-Output System (BIOS) which may control basic hardware and/or software operation such as the interaction with peripheral components or devices. For example, the physiological data detection module 445 to implement the present systems and methods may be stored within the memory 410. Applications resident with system 400 are generally stored on and accessed via a non-transitory computer readable medium, such as a hard disk drive or other storage medium. Additionally, applications may be in the form of electronic signals modulated in accordance with the application and data communication technology when accessed via a network interface (e.g., transceiver module 430, one or more antennas 435, etc.).

Many other devices and/or subsystems may be connected to, or may be included as, one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems may be interconnected in different ways from that shown in FIG. 4. In some embodiments, an aspect of some operation of a system, such as that shown in FIG. 4, may be understood in the art and is not discussed in detail in this application. Code to implement the present disclosure may be stored in a non-transitory computer-readable medium such as one or more of memory 410 or other memory. The operating system provided on input/output controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the apparatus (e.g., 205-*b*) may include a single antenna 435, the apparatus (e.g., 205-*b*) may have multiple antennas 435 capable of concurrently transmitting and/or receiving multiple wireless transmissions.

The apparatus 205-*b* may include an event detection module 215-*b*, which may perform the functions described above for the event detection modules 215, 215-*a* of apparatus 205, 205-*a* of FIGS. 2 and 3, among others.

Figure 5:
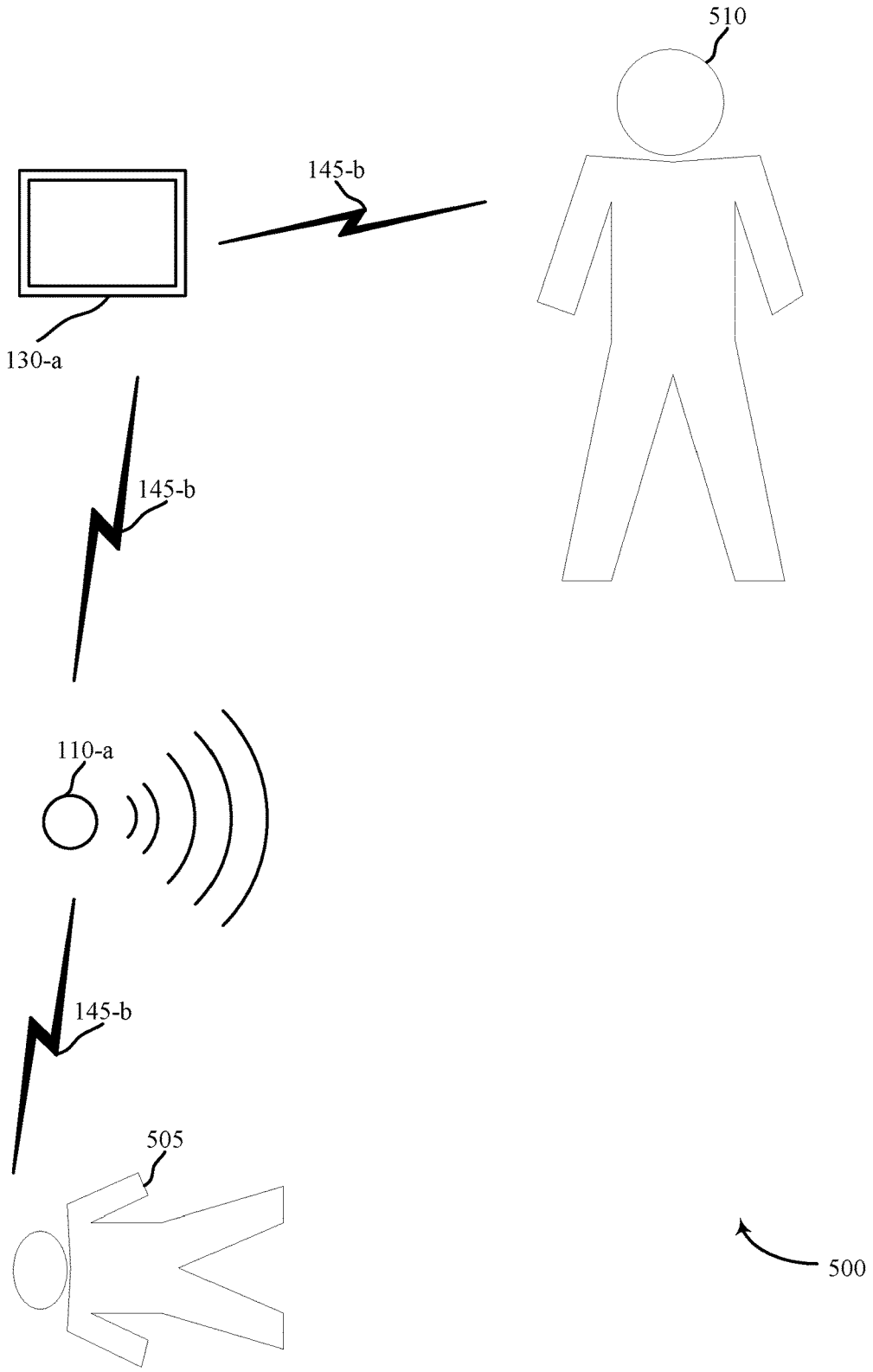
FIG. 5 shows a block diagram illustrating an example use of a security and/or an automation system, in accordance with various aspects of this disclosure.

FIG. 5 is a block diagram illustrating an example of the targeted baby monitoring system 500. In the illustrated example, one or more sensor units 110-*a* may detect data associated with a baby or other monitored occupant 505. For example, sensor unit 110-*a*, which may be an example of one or more sensor units 110 described with respect to FIG. 1, may detect audio and/or video data, physiological data, movement data, environmental data, and/or the like. In some examples, sensor unit 110-*a* may process the detected data associated with the monitored baby in order to derive an event condition. In some examples, this processing may include comparing the data and/or a subset of the data to one or more conditions, such as a predetermined threshold based at least in part on audio and/or video data, physiological data, movement data, environmental data, and/or the like.

In other examples, sensor unit 110-*a* may pass the detected data directly on to control panel 130-*a*, which may be an example of control panel 130 described with reference to FIG. 1. Although illustrated as a control panel 130-*a* in targeted baby monitoring system 500, in other examples sensor unit 110-*a* may communicate detected data to a local computing device or remote computing device (e.g., 115 and/or 140), as previously discussed. Upon receiving the detected data, control panel 130-*a* may also either derive an event condition, or may communicate the detected data directly to the monitoring user 510. Where control panel 130-*a* derives an event condition, as discussed above with respect to FIGS. 2 and 3, control panel 130-*a* may receive data associated with the baby, such as audio or physiological data, and may compare the received data with a predetermined event threshold to determine whether an event condition exists. Where control panel 130-*a* determines that an event condition exists, control panel 130-*a* may further determine whether to derive an alert, or to communicate the data associated with the event condition to the monitoring user 510, based on inputted user preferences. Thus, control panel 130-*a* may communicate to the monitoring user 510 a live audio and/or video stream in some examples, or may communicate an alert, for example in the form of an audio or haptic alarm, to the monitoring user 510 in other examples.

The monitoring user 510 may receive the data or alert by one or more means. In some examples, the monitoring user 510 may receive a live audio stream of his baby crying as a push notification on his smartphone device, based upon a signal communicated from the control panel 130-*a* or other component of the automation and/or security system to the monitoring user's 510 smartphone (e.g., communication links 145-*b*) and/or other device. In some examples, an alert may be displayed on a screen integrated with the control panel 130-*a*, notifying the monitoring user 510 that his baby has awoken and/or is standing up in his crib. This standing condition may be determined, for example, by one or more sensor unit 110-*a* detecting changes in movement or height of the monitored baby, utilizing video or motion detection methods. In some examples, the monitoring user 510 may receive an alert in the form of flashing lights in the room in which he is located.

The control panel 130-*a* may further be configured to detect specific occupancy data with respect to one or more occupants in the home, and to determine to where to communicate the data or alert associated with the monitored baby based on that occupancy data. For example, control panel 130-*a* may receive occupancy data from one or more sensor units, which may be the same sensor unit 110-*a* illustrated in targeted baby monitoring system 500, and/or may be a different sensor unit, indicating which rooms or areas of the home are currently occupied. This occupancy data may be determined based on any occupancy detection means, such as using movement data, temperature data, audio data, visual data, vibration data, signal data emitted from a device associated with the occupant, and the like.

Control panel 130-*a* may further receive, determine, derive, calculate, and/or evaluate specific identity and/or physiological data associated with the identified occupants. For example, control panel 130-*a* may receive data indicating that occupants in the living room and kitchen are awake, while occupants in the upstairs bedroom are asleep. As another example, control panel 130-*a* may receive data indicating the particular identity of the occupants in the living room, kitchen, and upstairs bedroom, as identified members of the household, extended family members who frequently visit, neighbors, known friends as determined by an electronic profile, and/or guests.

In some examples, control panel 130-*a* may receive environmental data associated with the occupants, such as ambient noise, time stamps, signals associated with one or more electronic devices, and/or light levels, in order to determine and/or select in which form the communicated data or alert associated with the monitored occupant 505 (e.g., a baby) should be delivered. In this way, control panel 130-*a* may use a plurality of data associated with the household in order to determine the most effective location and means by which to communicate data or alerts associated with the monitored occupant 505 in order to ensure delivery of the data or alerts. Additionally, by detecting occupancy data, control panel 130-*a* may allow for real-time monitoring of the monitored occupant 505 in the monitoring user's 510 current location, as the monitoring user 510 moves throughout the home. Thus, while the live audio stream of the baby crying may initially be broadcast in the living room, upon detecting that the monitoring user 510 has moved to the kitchen, control panel 130-*a* may broadcast the audio stream from another component of the automation and/or security system located in the kitchen, and so on. As described, the present systems and methods may rely on continuous occupancy monitoring, monitoring at certain intervals (e.g., every 5 minutes, 10 minutes, 30 minutes, etc.), monitoring based on varying sensor data (e.g., sensing movement in a first room and then sensing movement in a second room and updating the occupancy status), or some combination thereof, and/or other monitoring techniques.

Figure 6:
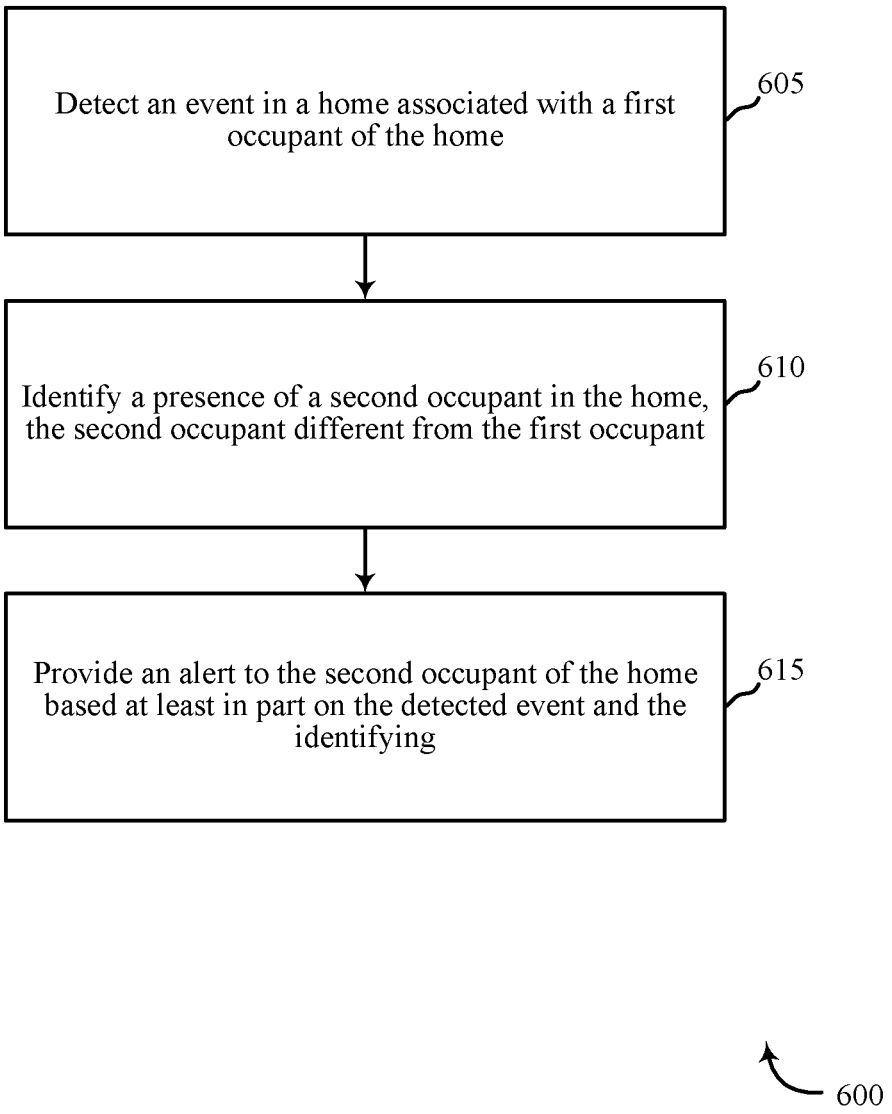
FIG. 6 is a flow chart illustrating an example of a method relating to a security and/or an automation system, in accordance with various aspects of this disclosure.

FIG. 6 is a flow chart illustrating an example of a method 600 for occupancy-targeted baby monitoring, in accordance with various aspects of the present disclosure. For clarity, the method 600 is described below with reference to aspects of one or more of the sensor units 110, local computing devices 115, 120, control panel 130, or remote computing device 140 described with reference to FIG. 1, and/or aspects of apparatus 205, 205-*a* described with reference to FIGS. 2 and 3. In some examples, a control panel may execute one or more sets of codes to control the functional elements of the one or more sensor units to perform the functions described below. Additionally or alternatively, the control panel may perform one or more of the functions described below using special-purpose hardware.

At block 605, the method 600 may include detecting an event in a home associated with a first occupant of the home. The event may be detected using one or more sensor units, which may be individually positioned at a plurality of locations throughout the home, or may be integrated or collocated with other components of a security and/or automation system in the home. For example, the event may be detected by an audio and/or video monitoring system positioned in a room with the first occupant. In other examples, the event may be detected by a physiological sensor attached to, in communication with, and/or integrated with a device positioned in the room with the first occupant. In some examples, the first occupant may be a baby, while in other examples, the first occupant may be an ill or elderly home occupant, or any other occupant in need of monitoring.

The detected event may be related to any audio, motion, or physiological change, or the like, that may be associated with a change in status of the first occupant. For example, the detected event may be the sound of a baby crying, where the baby is the first occupant. In another example, the detected event may be a determination that the baby has moved from a reclined position to a standing position in his crib and/or from a supine position to a prone position. These determinations based on position may be based at least in part on one or more sensors and/or video data and analysis determining a monitored occupant's first position at a first time and the monitored occupant's second position at a second time. In some examples, the detected event may be a determination that the baby's heart rate has dropped below or increased above a predetermined heart rate threshold. Other events associated with a baby or other monitored household member are also envisioned. In some examples, the detected events may be based on one or more combinations of different data, changes, and/or other information. For example, an event may be detected based on audio and movement data.

At block 610, the method 600 may include identifying a presence of a second occupant in the home, the second occupant different from the first occupant. Detection of the second occupant may also be performed by one or more individually mounted or positioned sensor units, or by one or more sensor units collocated and/or integrated with one or more components of the home security and/or automation system. Identification of the presence of the second occupant in the home may be achieved by any occupancy detection means, such as by monitoring movement data, audio data, vibration data, or some combination thereof, and/or the like. Identification of the presence of the second occupant may include identifying the second occupant's particular location within the home, such as in the kitchen or living room. In other examples, identification of the presence of the second occupant may include identifying the second occupant's relative location within the home, such as in a room that is a certain distance and/or time (based on an average and/or calculated) away from the monitored person's room. In some examples, block 610 may include identifying the presence of multiple occupants, where the identified occupants are different from the first occupant. The particular location of each of the identified occupants may also be identified.

At block 615, the method 600 may include providing an alert to the second occupant of the home based at least in part on the detected event and the identifying. In some examples, the provided alert may take the form of a real-time audio stream associated with the first occupant; specifically, the provided alert may be an audio stream of the baby crying, broadcasted over a speaker component of the home security and/or automation system. In other examples, the provided alert may take the form of an alert derived from the detected event. For example, where the detected event includes detecting that the baby's heart rate has increased above a predetermined threshold, a visual alert message providing details of the event may be derived and displayed, for example on a control panel in the home. In some examples, the provided alert may be a combination of a live relaying of the monitored baby's condition, along with a derived alert. For example, a live video stream of the baby, taken from a video monitor positioned in the baby's room, may be communicated to the second occupant at a smartphone or personal computing device, along with a haptic alert, such as a vibration, and a push notification. In any example, the alert may be provided directly to the second occupant(s) where the second occupant's location in the home has been identified at block 610. In this way, occupancy-targeted baby monitoring may be achieved, such that the alert may be provided with specificity to interested parties based on their current locations in the home.

Figure 7:
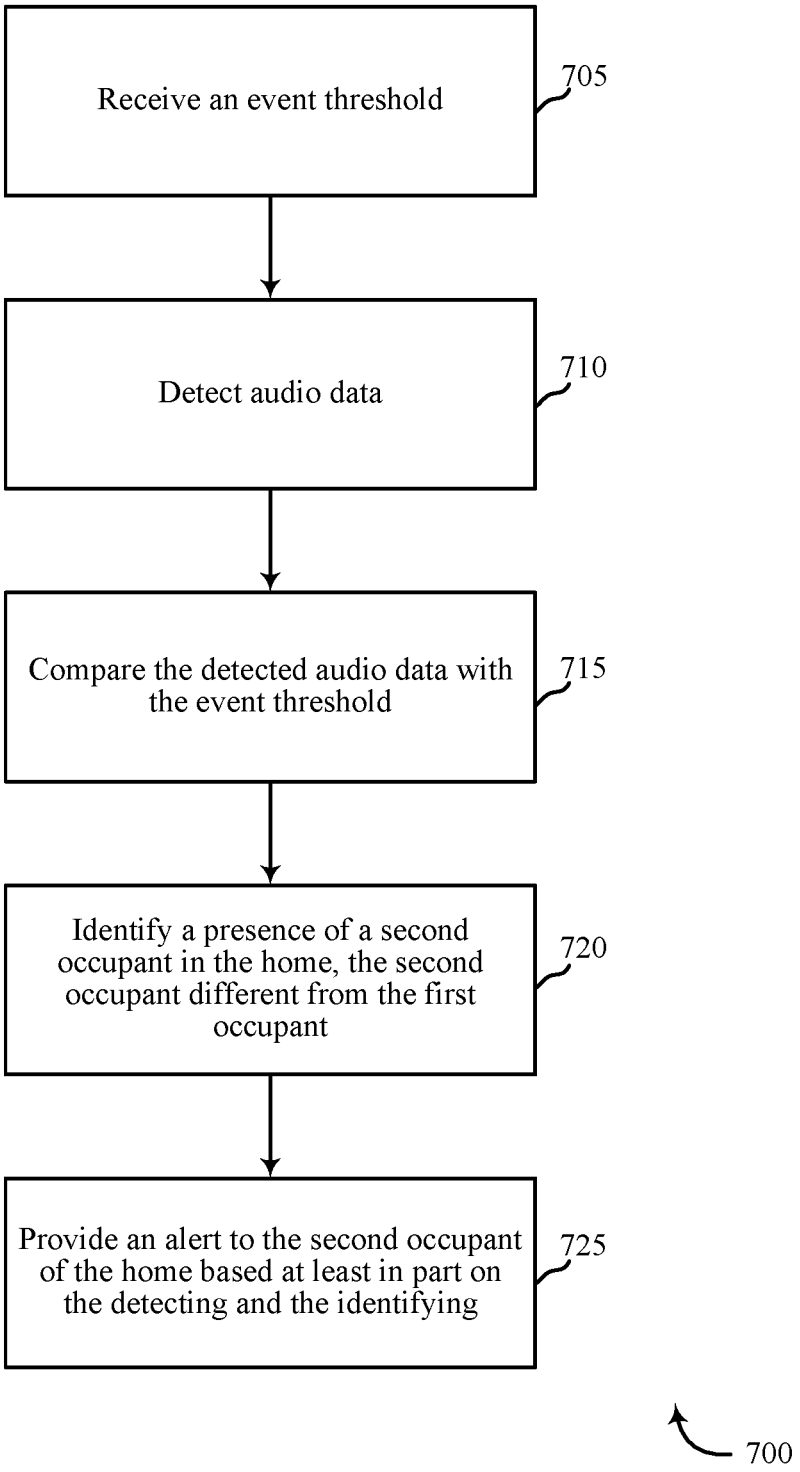
FIG. 7 is a flow chart illustrating an example of a method relating to a security and/or an automation system, in accordance with various aspects of this disclosure.

FIG. 7 is a flow chart illustrating an example of a method 700 for occupancy-targeted baby monitoring, in accordance with various aspects of the present disclosure. For clarity, the method 700 is described below with reference to aspects of one or more of the sensor units 110, local computing devices 115, 120, control panel 130, or remote computing device 140 described with reference to FIG. 1, and/or aspects of apparatus 205, 205-*a* described with reference to FIGS. 2 and 3, among others. In some examples, a control panel may execute one or more sets of codes to control the functional elements of the one or more sensor units to perform the functions described below. Additionally or alternatively, the control panel may perform one or more of the functions described below using special-purpose hardware.

At block 705, the method 700 may include receiving an event threshold. This event threshold may be received as direct input by an occupant in the home. For example, a parent may input a preference at a control panel in his home relating to a baby crying threshold, indicating that detected baby crying may only constitute an event where the crying is above a certain decibel level and/or endures for a certain period of time. Any crying detected below that threshold may not be considered to constitute an event. In other embodiments, the event threshold received at block 705 may be the result of a default, generated, learned, and/or other setting on the system, in some examples based on commonly recognized standards, instructions, and/or protocols. For example, the event threshold may indicate that detected heart rates above 100 beats per minute are generally considered to be unhealthy when not associated with exercise, and accordingly such detected heart rates may constitute an event. In another example, the event threshold may indicate that a determination that the baby has transitioned from a reclined to a standing position, but not from a reclined to a seated position, constitutes an event. Thus, using, for example, one or more video and motion detection components, the system may detect the baby's posture, and may derive an event condition accordingly.

At block 710, the method 700 may include detecting audio data. Although described in method 700 as audio data, block 710 may also or alternatively include detecting other data associated with the monitored occupant, such as movement data or other physiological data. Audio or other data detection at block 710 may include utilizing one or more sensor units, where the sensor units may be components of the home automation and/or security system, positioned independently in some examples, and/or collocated and/or integrated with other components of the system in other examples. For example, one sensor unit may take the form of a microphone integrated with a device in the home, while another sensor unit may be configured as an audio detection component of a video monitor and/or local computing device.

At block 715, the method 700 may include comparing the detected audio data with the event threshold. For example, the event threshold may indicate that only crying data exceeding 115 decibels and/or enduring for over 5 minutes constitutes an event. Accordingly, the audio data detected by one or more sensor units or microphone components positioned near the first occupant may be compared with this event threshold to determine whether an event condition is met. In some examples, where the audio data does not meet or exceed the event threshold, the audio data and/or alert may not be communicated to the second occupant. In some examples, where the audio data does not meet or exceed the event threshold, the audio data and/or alert may be communicated to the second occupant based on one or more preferences. In some examples, these one or more preferences may include a preference to convey the audio data and/or alert in such a way as to inform the user of the data or event, but not to require immediate attention (e.g., based on a push notification, information provided in an audio or visual alert, a summary report after a certain time interval, etc.). Where the audio data does meet or exceed the event threshold, the method 700 may proceed to block 720.

At block 720, the method 700 may include identifying a presence of a second occupant in the home, the second occupant different from the first occupant. As discussed above, the step of identifying the presence of the second occupant may include utilizing any occupancy detection means, facilitated by components of the home automation and/or security system. For example, the second occupant may be identified using motion data, thermal data, signal data from a wireless device associated with the second occupant, vibration data, or some combination thereof, and/or the like. In some examples, identifying the presence of the second occupant may include identifying the presence of a plurality of occupants, where the plurality of occupants are different from the first occupant. Further, in some examples, identifying the presence of the second occupant may include identifying a particular location of the second occupant (or location of each of the plurality of second occupants and/or a subset of the plurality of second occupants) within the home.

At block 725, the method 700 may include providing an alert to the second occupant of the home based at least in part on the detecting and the identifying. As previously discussed, the provided alert may take the form of a live stream of audio and/or video data associated with the first occupant in some examples, or may take the form of a derived alert, such as a visual or audio message or alarm, or a haptic alert, in other examples. The alert may also take other different forms. The alert may be provided to the second occupant(s) at his, her, or their specific position(s) in the home, based at least in part on the detected occupancy data. For example, the alert may be communicated to a second occupant in the kitchen by displaying a message on a control panel mounted on the kitchen wall. In another example, the alert may be communicated to the second occupant in the garage by sending a push notification to his smartphone. Other alert formats are also envisioned.

Thus, the method 700 may provide for occupancy-targeted baby monitoring by providing alerts or monitored data only when the detected event has satisfied an event threshold. In this way, a parent may be spared numerous "false positives" throughout the night as his baby makes harmless, insignificant noises or movements. It should be noted that the method 700 is just one implementation and that the operations of the method 700 may be rearranged or otherwise modified such that other implementations are possible.

Figure 8:
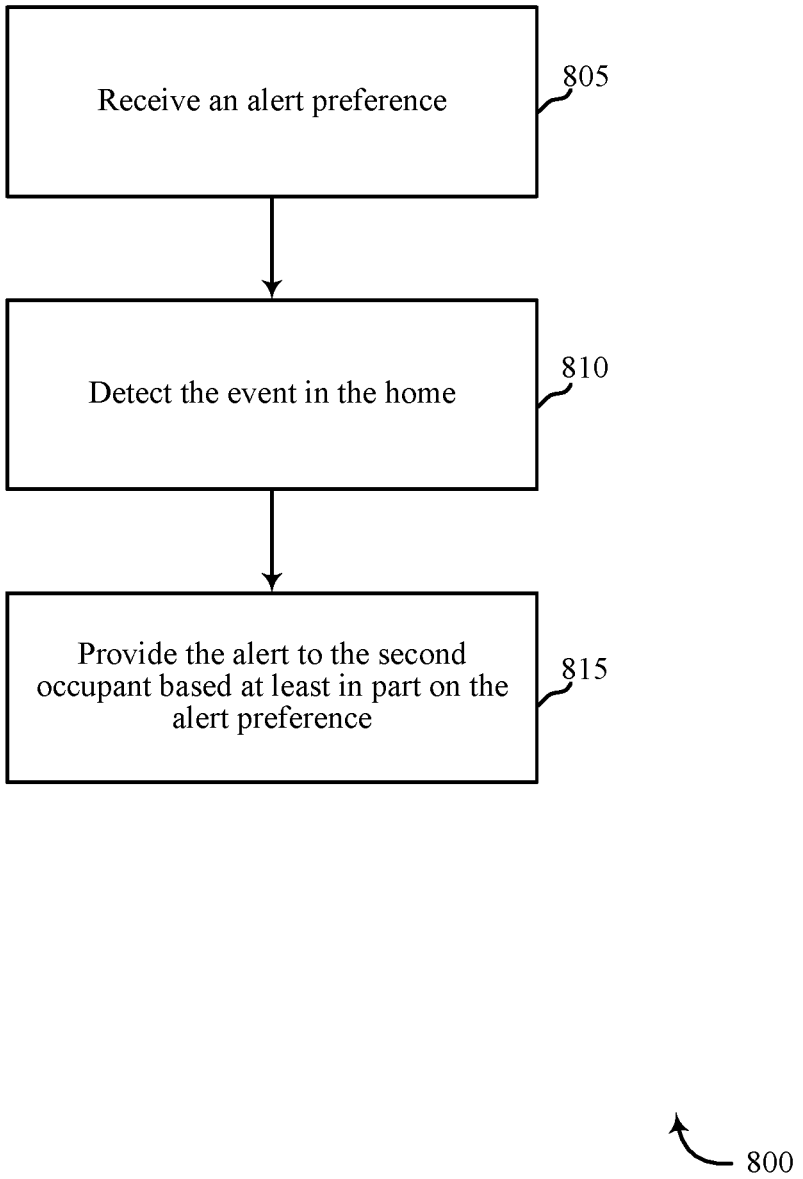
FIG. 8 is a flow chart illustrating an example of a method relating to a security and/or an automation system, in accordance with various aspects of this disclosure.

FIG. 8 is a flow chart illustrating an example of a method 800 for providing occupancy-targeted baby monitoring according to specific user preferences, in accordance with various aspects of the present disclosure. For clarity, the method 800 is described below with reference to aspects of one or more of the sensor units 110, local computing devices 115, 120, control panel 130, or remote computing device 140 described with reference to FIG. 1, and/or aspects of apparatus 205, 205-*a* described with reference to FIGS. 2 and 3, among others. In some examples, a control panel may execute one or more sets of codes to control the functional elements of the one or more sensor units to perform the functions described below. Additionally or alternatively, the control panel may perform one or more of the functions described below using special-purpose hardware.

At block 805, the method 800 may include receiving an alert preference. The alert preference may be inputted, for example, by an occupant at a control panel or dedicated application on his smartphone associated with the home automation and/or security system. The inputted alert preference may pertain to any element of the provided alert. For example, the alert preference may provide a preferred form in which the alert should be conveyed, such as via live audio and/or video stream, prerecorded audio or visual alert message, haptic alarm at the occupant's smartphone or personal computing device, or the like. The inputted alert preference may also or alternatively pertain to preferred recipients and/or devices of the alert. For example, the alert preference may indicate that only the parents in the household wish to receive the alerts, while children or guests in the home should not receive alerts.

In some embodiments, the alert preference settings may include an ability for one or more users to select how one or more alerts will be provided to multiple users. For example, a user may select an alternating alert pattern so that a first monitoring user (e.g., a father) will receive a first alert based on a first detected event, while a second monitoring user (e.g., a mother) will receive a second alert based on a second detected event. This alternating pattern may also, in some embodiments, vary based on one or more other types of data. For example, a user may elect that a first monitoring user will receive all alerts during a first period (e.g., 10 pm to 2 am), while a second monitoring user will receive all alerts during a second period (e.g., 2 am to 6 am).

As another example, the patterns may be more sophisticated and complex, such as providing a combination of time-based, category of alert-based, or alternating pattern-based alerts, and/or other combinations of alerts. For example, two monitoring users may receive alternating alerts (or some other pattern) over a first period, but then a second monitoring user may receive alerts over the second period to allow a first monitoring user a break from alerts. In some embodiments, a second monitoring user may receive alerts based on whether a first monitoring user has or has not acknowledged and/or responded to an alert (e.g., based on the first monitoring user moving, actuating a device, and/or some other input). For example, if the first monitoring user sleeps through an alert and does not respond to and/or acknowledge the alert, a second user may receive an alert (e.g., on a device and/or by some other method).

Accordingly, where the system detects that the children are in the bedrooms upstairs, a guest is in the kitchen, and the parents are in the living room, each by using occupancy and occupant identification methods and/or devices, the system may target any alerts only to the parents in the living room.

At block 810, the method 800 may include detecting the event in the home. As previously discussed, detecting an event may include detecting any audio, movement, and/or physiological data associated with the monitored first occupant, or may include detecting or registering only that audio, movement, and/or physiological data which satisfies a predetermined event threshold, among other things.

At block 815, the method 800 may include providing an alert to the second occupant based at least in part on the alert preference. Thus, where an event is detected at block 810, the system may communicate an alert associated with that event to the second occupant(s) using that occupant's particular alert preferences with respect to form and/or location of the alert. For example, where the detected event at block 810 indicates that a baby has been crying at a sufficient decibel level for a sufficient period of time as determined by the event threshold, and where the second occupant has indicated that any alerts should be delivered as push notifications to his smartphone, the system may, at block 815, send a push notification to the second occupant's smartphone alerting him to the crying event.

In some examples, aspects from two or more of the methods 600, 700, and 800 may be combined, omitted, and/or separated. It should be noted that the methods 600, 700, and 800 are just example implementations, and that the operations of the methods 600-800 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for security and/or automation systems, comprising:

receiving, by a processor, one or more alert preferences from a first occupant of a home;

detecting, by the processor, audio data associated with a second occupant of the home;

identifying, by the processor, an event threshold;

comparing, by the processor, the audio data with the event threshold to determine whether the audio data satisfies the event threshold;

detecting, by the processor, an event in the home associated with the second occupant based at least in part on comparing the audio data with the event threshold; and providing, by the processor, an alert to the first occupant of the home based at least in part on the one or more alert preferences and the detected event.

2. The method of claim 1, further comprising:

identifying a presence of the first occupant in the home, wherein the second occupant is different from the first occupant.

3. The method of claim 1, further comprising:

monitoring one or more parameters associated with the second occupant of the home, wherein detecting the audio data is based at least in part on the one or more parameters.

4. The method of claim 1, wherein identifying the event threshold is based at least in part on receiving an event threshold preference from the first occupant of the home.

5. The method of claim 1, wherein the event comprises at least one of a baby crying event, a baby movement event, a physiological event, or a combination thereof.

6. The method of claim 5, wherein the physiological event is based at least in part on physiological data, the physiological data comprising at least one of a heart rate, or a respiration rate, or movement data, or a combination thereof.

7. The method of claim 1, further comprising:

receiving one or more physiological data associated with the second occupant, wherein identifying the event threshold is based at least in part on the received physiological data.

8. The method of claim 1, wherein the one or more alert preferences comprise at least one of an individual occupant to alert, or a location at which to provide the alert, or a form in which to provide the alert, or a combination thereof.

9. The method of claim 1, further comprising:

determining a first location of the first occupant and a second location of a user device associated with the first occupant; and providing the alert to the user device associated with the first occupant based at least in part on the first location and the second location.

10. The method of claim 9, further comprising:

comparing the first location of the first occupant with the second location of the user device, wherein the user device comprises at least one of a camera, or a speaker, or a control panel, or a personal computing device; and providing the alert to the user device based at least in part on the comparing.

11. The method of claim 1, wherein the provided alert comprises at least one of an auditory alert, or a visual alert, or a haptic alert, or an audio stream, or a video stream, or a combination thereof.

12. The method of claim 1, wherein the provided alert is communicated to the first occupant by at least one of a camera, or a speaker, or a control panel, or a personal computing device, or a combination thereof.

13. An apparatus for security and/or automation systems, comprising:

a processor;

memory in electronic communication with the processor; and instructions stored in the memory, the instructions being executable by the processor to:

receive one or more alert preferences from a first occupant of a home;

detect audio data associated with a second occupant of the home;

identify an event threshold;

compare the audio data with the event threshold to determine whether the audio data satisfies the event threshold;

detect an event in the home associated with the second occupant based at least in part on comparing the audio data with the event threshold; and provide an alert to the first occupant of the home based at least in part on the one or more alert preferences and the detected event.

14. The apparatus of claim 13, wherein the instructions are further executable by the processor to:

identify a presence of the first occupant in the home, wherein the second occupant is different from the first occupant.

15. The apparatus of claim 13, wherein the instructions are further executable by the processor to:

monitor one or more parameters associated with the second occupant of the home, wherein detecting the audio data is based at least in part on the one or more parameters.

16. The apparatus of claim 13, wherein identifying the event threshold is based at least in part on receiving an event threshold preference from the first occupant of the home.

17. The apparatus of claim 13, wherein the event comprises at least one of a baby crying event, a baby movement event, a physiological event, or a combination thereof.

18. The apparatus of claim 17, wherein the physiological event is based at least in part on physiological data, the physiological data comprising at least one of a heart rate, or a respiration rate, or movement data, or a combination thereof.

19. A non-transitory computer-readable medium storing computer-executable code, the code executable by a processor to:

receive one or more alert preferences from a first occupant of a home;

detect audio data associated with a second occupant of the home;

identify an event threshold;

compare the audio data with the event threshold to determine whether the audio data satisfies the event threshold; and provide an alert to the first occupant of the home based at least in part on the one or more alert preferences and the detected event.

20. The non-transitory computer-readable medium of claim 19, wherein the code is further executable by the processor to:

identify a presence of the first occupant in the home, wherein the second occupant is different from the first occupant.

* * * * *